US006808373B2

(12) United States Patent
Suefuji et al.

(10) Patent No.: US 6,808,373 B2
(45) Date of Patent: Oct. 26, 2004

(54) SCROLL FLUID MACHINE HAVING PROJECTIONS ON A WRAP PERIPHERAL SURFACE

(75) Inventors: Kazutaka Suefuji, Kanagawa-ken (JP); Hiroyuki Mihara, Kanagawa-ken (JP); Susumu Sakamoto, Kanagawa-ken (JP); Koji Fukui, Tokyo (JP); Yoshio Kobayashi, Kanagawa-ken (JP)

(73) Assignee: Tokico Ltd., Kawasaki (JP)

( * ) Notice: Subject to any disclaimer, the term of this patent is extended or adjusted under 35 U.S.C. 154(b) by 0 days.

(21) Appl. No.: 10/654,476

(22) Filed: Sep. 4, 2003

(65) Prior Publication Data

US 2004/0062671 A1 Apr. 1, 2004

(30) Foreign Application Priority Data

Sep. 27, 2002 (JP) ..... 2002-284044

(51) Int. Cl.[7] ..... F01C 1/04
(52) U.S. Cl. ..... 418/55.2
(58) Field of Search ..... 418/55.2

(56) References Cited

U.S. PATENT DOCUMENTS 5,591,022 A * 1/1997 Protos ..... 418/55.2

FOREIGN PATENT DOCUMENTS

JP 63-134879 * 6/1988 ..... 418/55.2
JP 5-141379 6/1993

OTHER PUBLICATIONS

Journal of Technical Disclosure No. 2001–1746 issued by the Japanese Institute of Invention and Innovation, Mar. 2001.

* cited by examiner

*Primary Examiner*—John J. Vrablik
(74) *Attorney, Agent, or Firm*—Wenderoth, Lind & Ponack, L.L.P.

(57) ABSTRACT

Inner peripheral projections are provided on the inner peripheral surface of a wrap portion of an orbiting scroll member, and outer peripheral projections are provided on the outer peripheral surface of the wrap portion. The inner and outer peripheral projections each have an approximately triangular transverse sectional configuration defined by a narrow top of the projection and a pair of concavely arcuate surfaces extending with a wide overall width so that the projections can prevent stress concentration with the concavely arcuate surfaces to increase the mechanical strength and can be readily machined by using a tool, e.g. an end mill. When contacting the mating wrap portion, the narrow tops of the projections are readily crushed or worn. Therefore, the tops of the projections can become fit to the wrap portion without strongly contacting it many times.

15 Claims, 9 Drawing Sheets

Fig. 6-A
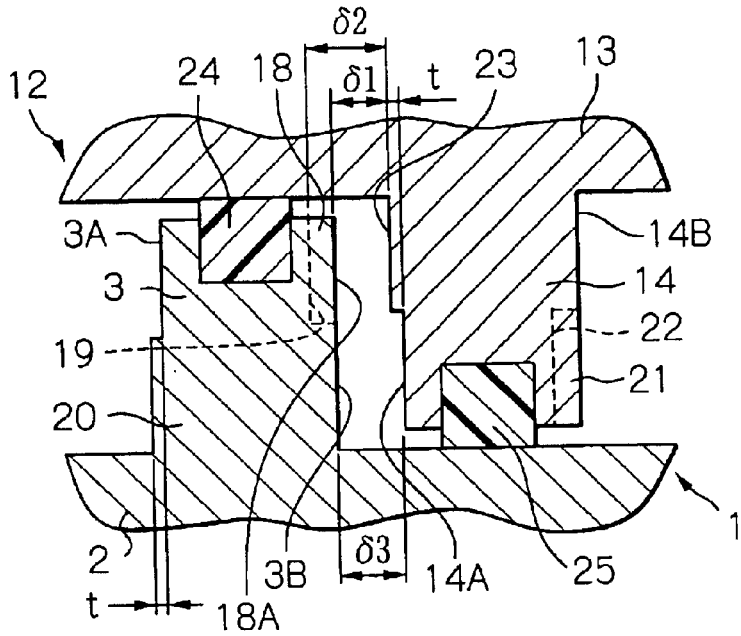
Fig. 6-B
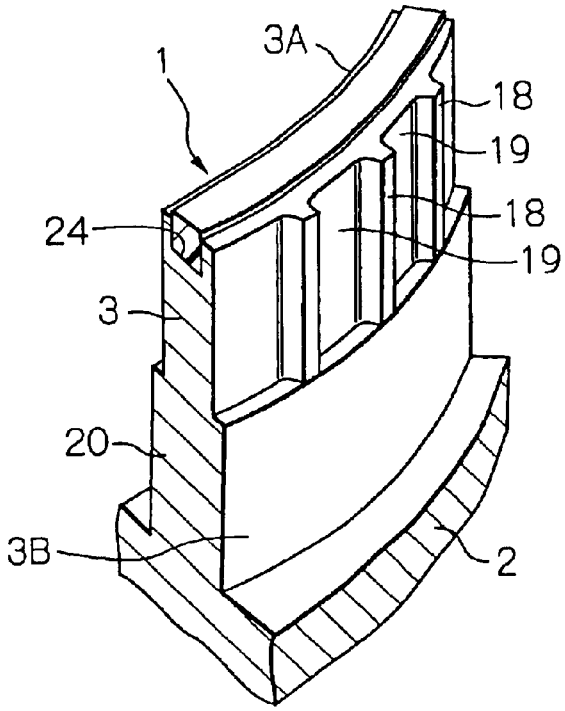

Fig. 6-C
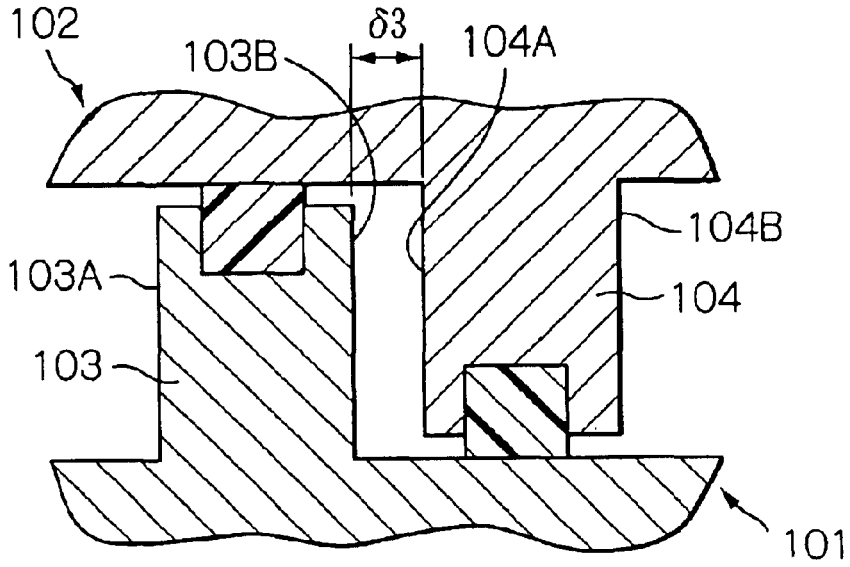
Fig. 6-D
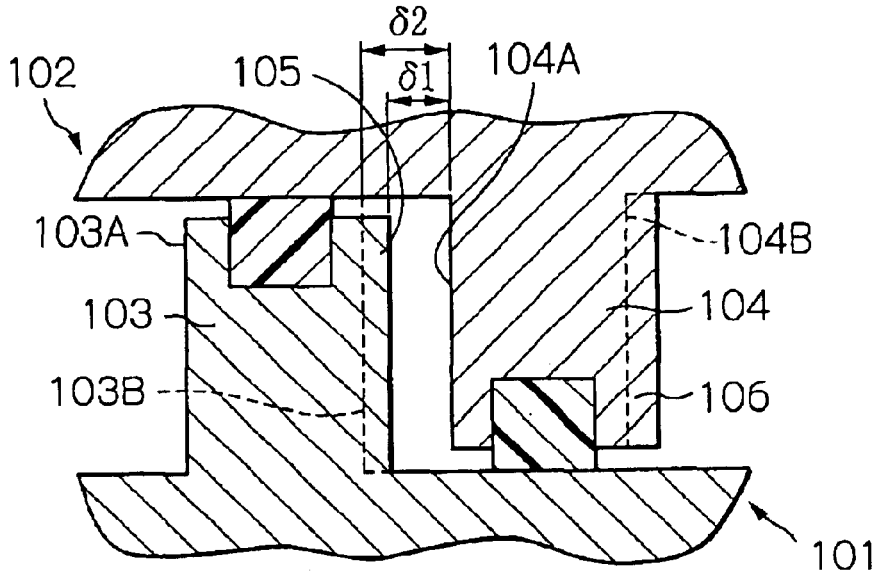

SCROLL FLUID MACHINE HAVING PROJECTIONS ON A WRAP PERIPHERAL SURFACE

BACKGROUND OF THE INVENTION

The present invention relates to a scroll fluid machine suitable for use as an air compressor, a vacuum pump, etc. by way of example.

In general, a scroll fluid machine includes a fixed scroll member and an orbiting scroll member provided facing the fixed scroll member. The fixed scroll member and the orbiting scroll member each have a disk-shaped end plate and a wrap portion projecting axially from the end plate. The wrap portion is wound spirally from the radially inner side toward the radially outer side of the end plate. Thus, the fixed scroll member and the orbiting scroll member define a plurality of compression chambers by overlapping of their wrap portions.

In the scroll fluid machine, the orbiting scroll member is driven by a driving shaft to perform an orbiting motion with respect to the fixed scroll member with a predetermined orbiting radius, thereby sucking a fluid, e.g. a gas, from a suction opening provided in a radially outer part of the fixed scroll member, and successively compressing the fluid in the compression chambers. Finally, the compressed fluid is discharged to the outside from a discharge opening provided in a radially inner part of the fixed scroll member.

There is a conventional scroll fluid machine having recesses or projections on the peripheral surfaces of the wrap portions to reduce the gap between the wrap portions, thereby increasing the degree of hermeticity in the compression chambers and thus improving the compression efficiency [for example, see Japanese Patent Application Unexamined Publication (KOKAI) No. Hei 5-141379 and Journal of Technical Disclosure No. 2001-1746 issued by the Japan Institute of Invention and Innovation].

In the scroll fluid machine according to the prior art, a plurality of axially extending projections (or recesses) are formed on the peripheral surfaces of the wrap portions of the fixed scroll member and the orbiting scroll member. The projections are formed on each wrap portion at approximately equal spacings along the spiral direction, that is, the circumferential direction of the wrap portion, throughout it from the radially inner side toward the radially outer side.

Incidentally, the above-described conventional scroll fluid machine has a plurality of axially extending projections (or recesses) on the peripheral surfaces of the wrap portions to minimize the amount of compressed fluid leaking out through the mutually opposing wrap portions, thereby increasing the degree of hermeticity in the compression chambers.

However, the projections provided in the prior art scroll fluid machine have a quadrangular transverse sectional configuration. Accordingly, the tip of each projection is wide in width. Therefore, when the projections contact the mating wrap portion, some problems arise, such as an increase in power loss due to frictional resistance, and generation of loud noise, and occurrence of scoring.

Further, the projections are formed on each wrap portion at approximately equal spacings along the circumferential direction of the wrap portion throughout it from the radially inner side toward the radially outer side. Therefore, the pitch of the projections is too large to close hermetically the compression chambers at the radially inner side where the radius of curvature of the wrap portion is small. Consequently, the compressed fluid may leak out, leading to a degradation of the compression efficiency.

Further, in a region where a plurality of projections come closest to the mating peripheral surface with the same distance from the peripheral surface at a certain timing, the fluid flows from a high-pressure side compression chamber into a low-pressure side compression chamber through a very small gap formed between the projections and the mating peripheral surface. At this time, vortex motion of the fluid occurs, and noise is generated on the principle of wind instruments.

Accordingly, the prior art suffers from the following problem. During the operation of the scroll fluid machine, noises are simultaneously generated from a plurality of positions between the fixed scroll member and the orbiting scroll member. These noises may leak to the outside from the fluid suction opening, etc. in the form of a loud noise of high frequency, causing the machine operating environment to be deteriorated.

Further, in the prior art, the peripheral surface of the wrap portion is provided with a plurality of projections (or recesses) extending over the entire axial length of the wrap portion. Consequently, at the region of the peripheral surface of the wrap portion where no projections are present, the gap between the wrap portion of the fixed scroll member and the wrap portion of the orbiting scroll member is larger than in the case of a scroll fluid machine not provided with projections. Accordingly, the compression efficiency degrades undesirably.

The present invention was made in view of the above-described problems with the prior art.

A first object of the present invention is to provide a scroll fluid machine designed to enhance the mechanical strength of the projections provided on the wrap portion to increase the degree of hermeticity in the compression chambers and also designed to be capable of preventing power loss, noise generation and so forth during the operation of the scroll fluid machine.

A second object of the present invention is to provide a scroll fluid machine designed to be capable of minimizing the leakage of the compressed fluid to improve the compression efficiency.

A third object of the present invention is to provide a scroll fluid machine designed to be capable of improving the compression efficiency with the projections provided on the wrap portion while suppressing the generation of noise and so forth due to the projections and realizing a quiet and favorable operating environment.

SUMMARY OF THE INVENTION

The present invention is applicable to a scroll fluid machine including one scroll member having a wrap portion projecting axially from an end plate. The wrap portion is wound spirally from the radially inner side toward the radially outer side of the end plate. The other scroll member is provided facing the one scroll member. The other scroll member has a wrap portion projecting axially from an end plate. The wrap portion is wound spirally from the radially inner side toward the radially outer side of the end plate so as to overlap the wrap portion of the one scroll member to define a plurality of compression chambers.

According to a feature of the present invention, at least the one scroll member has on a peripheral surface of the wrap portion thereof a plurality of axially extending projections at spacings in the spiral direction of the wrap portion. Each projection has a transverse sectional configuration defined by the top of the projection and slopes connecting the top to the peripheral surface. Each slope has a concave surface at a portion thereof that is contiguous to the peripheral surface.

With the above-described arrangement, each projection is formed in an approximately triangular transverse sectional configuration. Therefore, it is possible to prevent stress concentration and to increase the mechanical strength at the tops of the projections. In addition, machining can be readily carried out by using a tool, e.g. an end mill. On the other hand, when contacting the opposing peripheral surface of the wrap portion of the other scroll member, the tops of the projections are readily crushed or worn. Therefore, the tops of the projections can become fit to the opposing peripheral surface of the wrap portion without strongly contacting it many times.

According to another feature of the present invention, the concave surface of the projections has a radius of curvature not less than that of a circular arc having a radius ¼ times the radial turn spacing T of the wrap portion.

With the above-described arrangement, the projections can be formed with the same tool, e.g. an end mill, as used to cut the peripheral surface of the wrap portion. That is, the projections can be formed when cutting the peripheral surface of the wrap portion by using the same tool, e.g. an end mill, without the need for tool change.

According to another feature of the present invention, the projections satisfy the following condition:

$$W1 \times 2 \leqq W2$$

where W1 is the width of the top, and W2 is the overall width of each projection.

With the above-described arrangement, the projections are widened at the root side thereof. Thus, the mechanical strength of the projections can be increased.

According to another feature of the present invention, the pitch of the projections in the spiral direction is narrow at the radially inner side but wide at the radially outer side.

With the above-described arrangement, a radially inner part of the wrap portion where the radius of curvature of the wrap portion is small and hence the curvature thereof is steep can be provided with a plurality of projections with a narrowed pitch along the steep curvature.

According to another feature of the present invention, the projections are formed at approximately equal angular spacings throughout the wrap portion from the radially inner side to the radially outer side.

With the above-described arrangement, the pitch of the projections in the spiral direction becomes narrow at the radially inner side but wide at the radially outer side. Thus, a radially inner part of the wrap portion where the radius of curvature of the wrap portion is small and hence the curvature thereof is steep can be provided with a plurality of projections with a narrowed pitch along the steep curvature.

According to another feature of the present invention, the projections are provided only on either one of the mutually opposing inner and outer peripheral surfaces of the wrap portions of the one scroll member and the other scroll member. Accordingly, the projections can be disposed to face a smooth peripheral surface of the mating wrap portion.

According to another feature of the present invention, the projections are provided in any one manner selected from among a manner in which the projections are provided on the inner peripheral surface and the outer peripheral surface of the wrap portion of the one scroll member, a manner in which the projections are provided on the inner peripheral surface and the outer peripheral surface of the wrap portion of the other scroll member, a manner in which the projections are provided on the inner peripheral surface of the wrap portion of the one scroll member and on the inner peripheral surface of the wrap portion of the other scroll member, and a manner in which the projections are provided on the outer peripheral surface of the wrap portion of the one scroll member and on the outer peripheral surface of the wrap portion of the other scroll member. In any of these cases, the projections can be disposed to face a smooth peripheral surface of the mating wrap portion.

According to another feature of the present invention, the top of each projection has a width W1 in the range of 0 mm$\leqq$W1$\leqq$2 mm. Accordingly, the tops of the projections can readily be crushed or worn when contacting the opposing peripheral surface of the wrap portion. Therefore, the tops of the projections can become fit to the opposing peripheral surface of the wrap portion without strongly contacting it many times.

According to another feature of the present invention, the projections satisfy the following condition:

$$S1 < S2$$

where S1 is a gap defined between the top of each of the projections provided on the inner peripheral surface of the wrap portion of one of a driven scroll member and the outer peripheral surface of the wrap portion of a fixed scroll member when the projections approach the outer peripheral surface, and S2 is a gap defined between the top of each of the projections provided on the outer peripheral surface of the wrap portion of the driven scroll member and the inner peripheral surface of the wrap portion of the fixed scroll member when the projections approach the inner peripheral surface.

With the above-described arrangement, when contact occurs between the radially opposing wrap portions, the inner peripheral surface of the wrap portion of the driven scroll member contacts the outer peripheral surface of the wrap portion of the fixed or follower scroll member before the outer peripheral surface of the former wrap portion contacts the inner peripheral surface of the latter wrap portion. Through this contact, force acts on the driven scroll member so as to rotate it in the same direction as that of rotating force. Thus, the driven scroll member is pressed in the direction of rotating force, so that backlash can be eliminated.

According to another feature of the present invention, the projections are provided on the wrap portion exclusive of the radially innermost part thereof. Accordingly, the projections can be provided only on a part of the entire length of the wrap portion where projections are needed to increase the degree of hermeticity in the compression chambers.

According to another feature of the present invention, the projections are formed only on a limited axial part of the wrap portion on the end plate away from the end plate.

With the above-described arrangement, for example, when one of the scroll members performs an orbiting motion, the projections on the one scroll member can be brought closest to or into contact with the wrap portion of the other scroll member at the trapping position of the compression chambers. Thus, the degree of hermeticity in the compression chambers can be increased by the projections. Further, because the projections are formed only on a limited axial part of the wrap portion away from the end plate, the axial length of the projections can be reduced, and noise generated by the projections can be minimized.

According to another feature of the present invention, the projections are formed only on a radially inner part of the wrap portion in the spiral direction, and the wrap portion has a non-projection forming region at the radially outer end thereof.

With the above-described arrangement, for example, the smooth peripheral surfaces of the wrap portions can be brought closest to or into contact with each other at the trapping position of compression chambers defined at the radially outermost side of the wrap portion. Accordingly, it is possible to favorably seal the radially outer compression chambers that have a significant effect on the volumetric efficiency during compression.

According to another feature of the present invention, the non-projection forming region is a part of the wrap portion corresponding to approximately one turn of the wrap portion that spirals radially inward from a compression starting position at which the wrap portion of the one scroll member and the wrap portion of the other scroll member come closest to each other at the radially outermost side.

With the above-described arrangement, for example, the sealing performance required for the radially outer compression chambers at the compression starting position and so forth can be improved. Further, because the non-projection forming region is provided over a length corresponding to approximately one turn of the wrap portion from the compression starting position toward the radially inner side, the smooth peripheral surfaces of the wrap portions can surely be brought closest to or into contact with each other at one point on the radially outer side. Accordingly, noise generated by the projections at the radially inner side can be surely blocked at the point where the smooth peripheral surfaces come closest to or in contact with each other and thus prevented from leaking to the outside.

BRIEF DESCRIPTION OF THE DRAWINGS

FIG. 6-A is a radial sectional view of a part of a scroll air compressor according to a second embodiment of the present invention.

FIG. 6-B is a fragmentary perspective view of a part of a fixed scroll member in the embodiment shown in FIG. 6-A.

FIG. 6-C is a radial sectional view showing a first comparative example for comparison with the embodiment shown in FIG. 6-A.

FIG. 6-D is a radial sectional view showing a second comparative example for comparison with the embodiment shown in FIG. 6-A.

DETAILED DESCRIPTION OF THE INVENTION

Embodiments of the scroll fluid machine according to the present invention will be described below by way of examples in which the present invention is applied to a scroll air compressor having projections provided on an orbiting scroll member.

First of all, a first embodiment of the present invention will be described in detail with reference to FIGS. 1 to 5.

Figure 1:
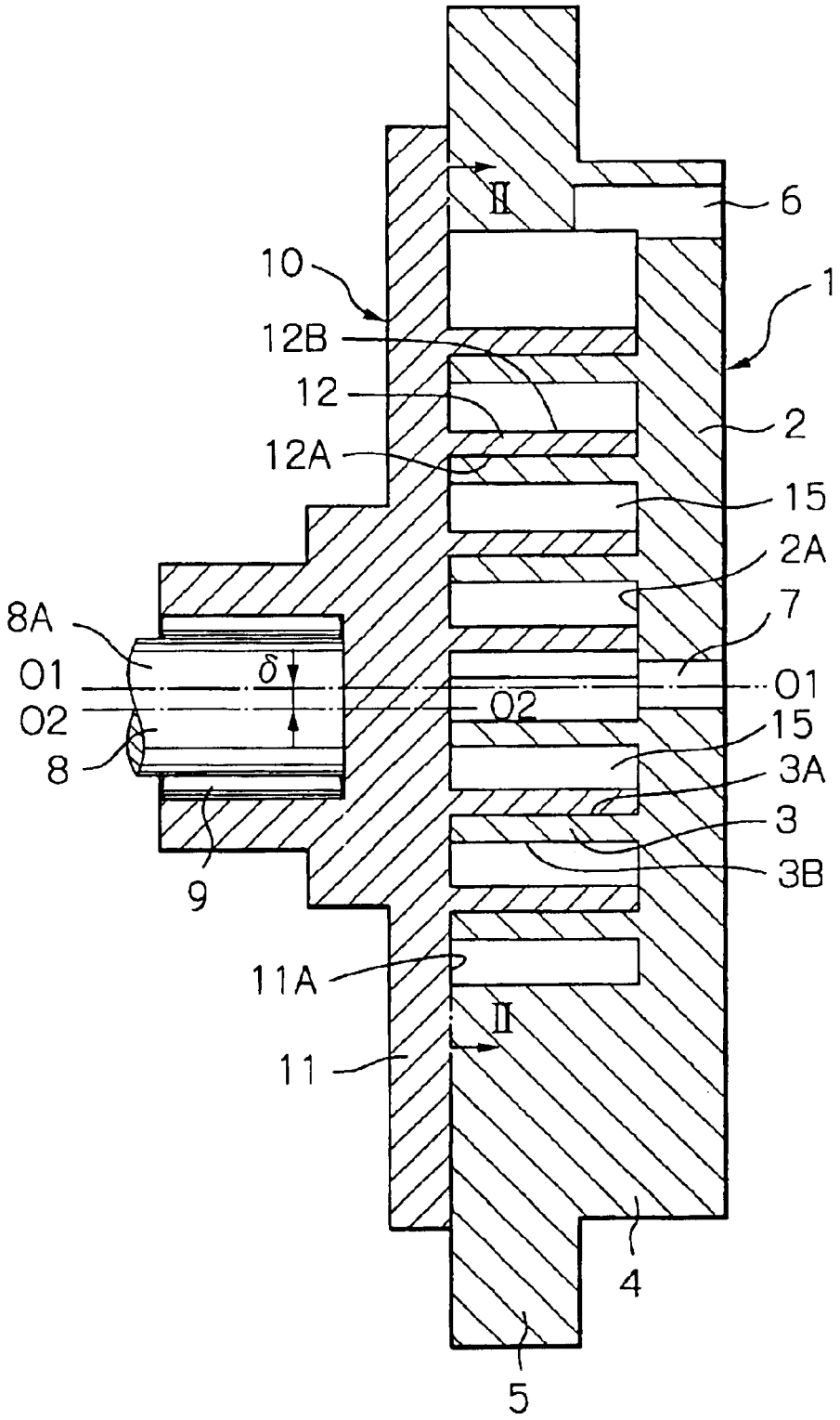
FIG. 1 is a longitudinal sectional view showing a scroll air compressor according to a first embodiment of the present invention.

FIG. 1 is a longitudinal sectional view of a scroll air compressor. The scroll air compressor has a fixed scroll member 1 secured to an end of a cylindrical casing (not shown). The fixed scroll member 1 has an end plate 2 formed in an approximately disk-like shape. The end plate 2 is positioned so that the center thereof is coincident with the axis O1—O1 of a driving shaft 8 (described later). A spiral wrap portion 3 is provided on a surface 2A of the end plate 2. A cylindrical portion 4 projects axially from the outer peripheral edge of the end plate 2 so as to surround the wrap portion 3. A flange portion 5 projects radially outward from the cylindrical portion 4.

Figure 2:
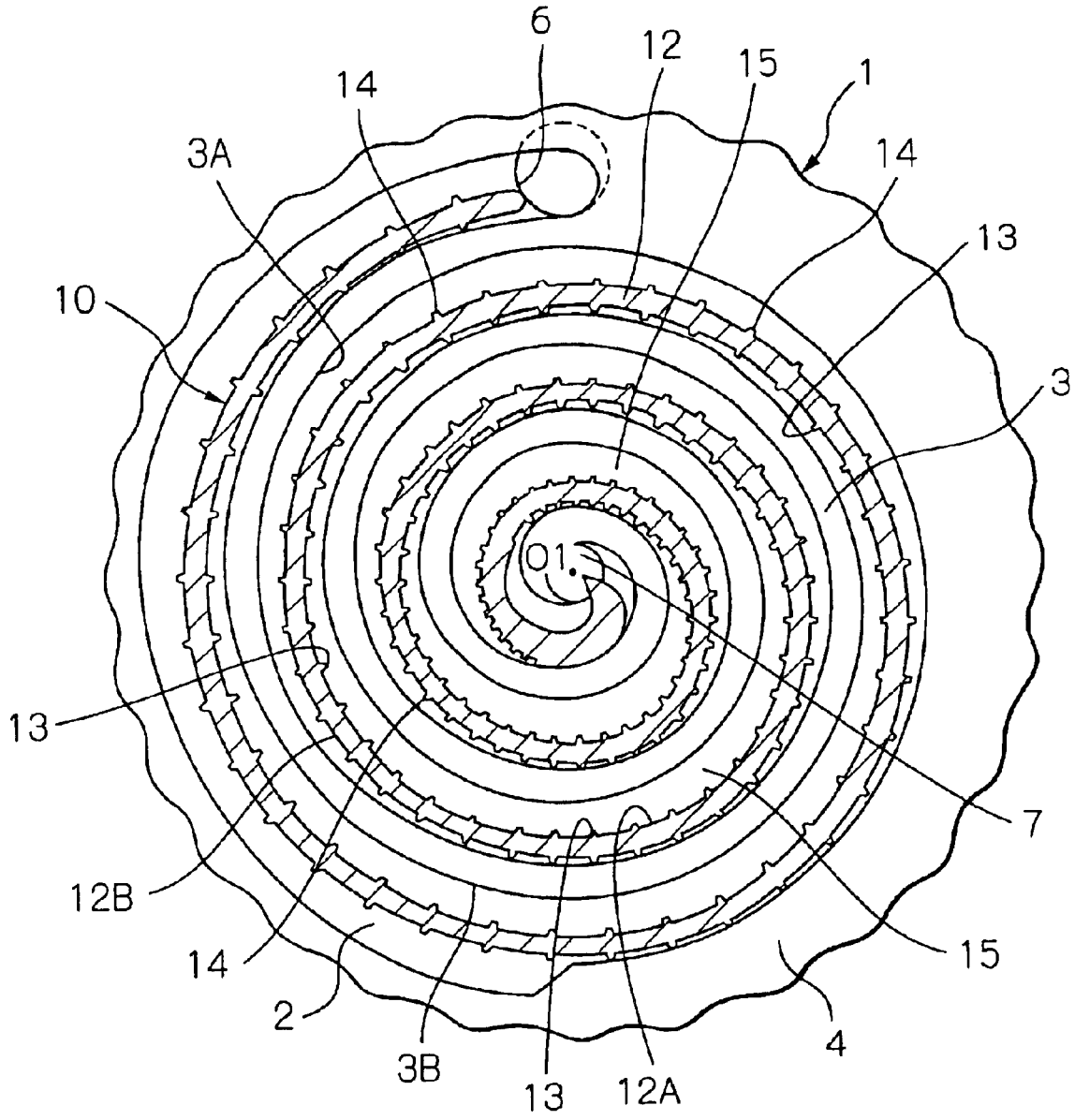
FIG. 2 is a transverse sectional view of the scroll air compressor as seen from the direction of the arrow II—II in FIG. 1.

FIG. 2 is a transverse sectional view of the scroll air compressor shown in FIG. 1. As shown in FIG. 2, the wrap portion 3 is formed in a spiral shape in which the radially inner end of the wrap portion 3 is a spiral starting end, and the radially outer end of the wrap portion 3 is a spiral terminating end. The inner peripheral surface 3A and the outer peripheral surface 3B of the wrap portion 3 are smooth surfaces, without a recess or a projection.

Further, the fixed scroll member 1 has a suction opening 6 provided in an outer peripheral portion of the end plate 2 to suck air into compression chambers 15 (described later) therethrough. The center of the end plate 2 is provided with a discharge opening 7 for discharging air compressed in the compression chambers 15.

A driving shaft 8 is rotatably provided in the casing. The driving shaft 8 has an axis O1—O1 as the center of rotation. An end portion of the driving shaft 8 closer to the fixed scroll member 1 extends eccentrically to form a crankshaft 8A. The center axis O2—O2 of the crankshaft 8A is eccentric with respect to the axis O1—O1 of the driving shaft 8 by an amount corresponding to an orbiting radius δ. The crankshaft 8A of the driving shaft 8 rotatably supports an orbiting scroll member 10 (described later) through an orbiting bearing 9.

The orbiting scroll member 10 is provided on the driving shaft 8 to face the fixed scroll member 1. The orbiting scroll member 10 has an end plate 11 formed in the shape of a disk centered at the axis O2—O2. The end plate 11 has a spiral wrap portion 12 projecting axially from a surface 11A of the end plate 11.

The orbiting scroll member 10 is positioned so that the wrap portion 12 overlaps the wrap portion 3 of the fixed scroll member 1 with an offset angle of 180 degrees, for example. Thus, a plurality of compression chambers 15 (described later) are defined between the two wrap portions 3 and 12. During the operation of the scroll air compressor, air is sucked into the radially outermost compression chamber 15 from the suction opening 6, and the sucked air is successively compressed in the compression chambers 15 while moving toward the radially inner side during the orbiting motion of the orbiting scroll member 10. Finally, the compressed air is discharged to the outside from the discharge opening 7.

The wrap portion 12 of the orbiting scroll member 10 projects axially (direction of the axis O1—O1) from the surface 11A of the end plate 11. The wrap portion 12 is formed in a spiral shape with n turns in which the radially inner end of the wrap portion 12 is a spiral starting end, and the radially outer end of the wrap portion 12 is a spiral terminating end. The radial turn spacing of the wrap portion 12, i.e. the spacing between the 1st turn and the 2nd turn, the spacing between the 2nd turn and the 3rd turn, . . . the spacing between the (n−1)th turn and the n th turn, is set at a dimension T. The inner peripheral surface 12A and the outer peripheral surface 12B of the wrap portion 12 are provided with a plurality of inner peripheral projections 13 and a plurality of outer peripheral projections 14 (described later), respectively. The wrap portion 12 is spirally formed by using a cutting tool, e.g. an end mill.

Figure 3:
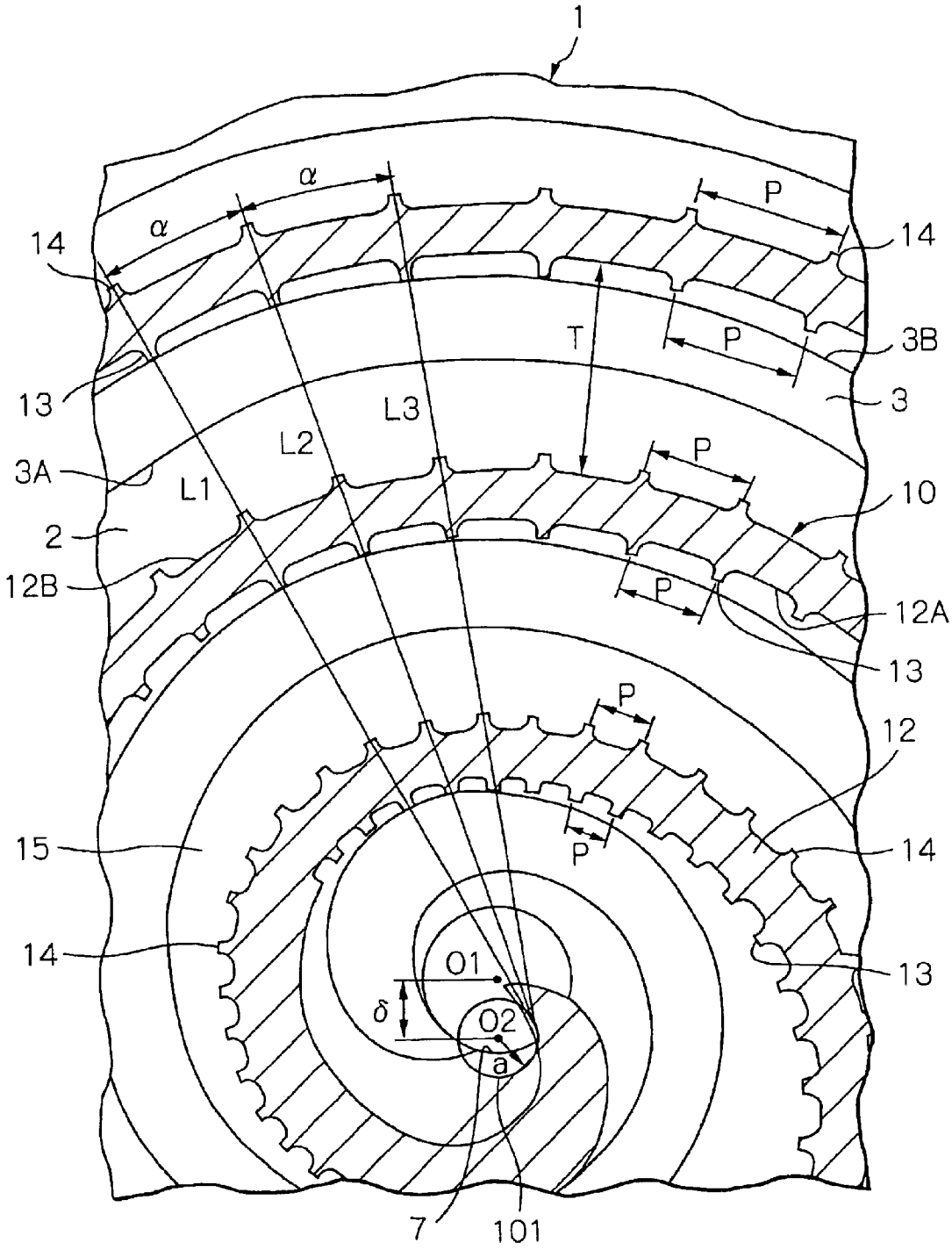
FIG. 3 is an enlarged fragmentary transverse sectional view showing a wrap portion of a fixed scroll member and a wrap portion of an orbiting scroll member in FIG. 2.
Figure 4:
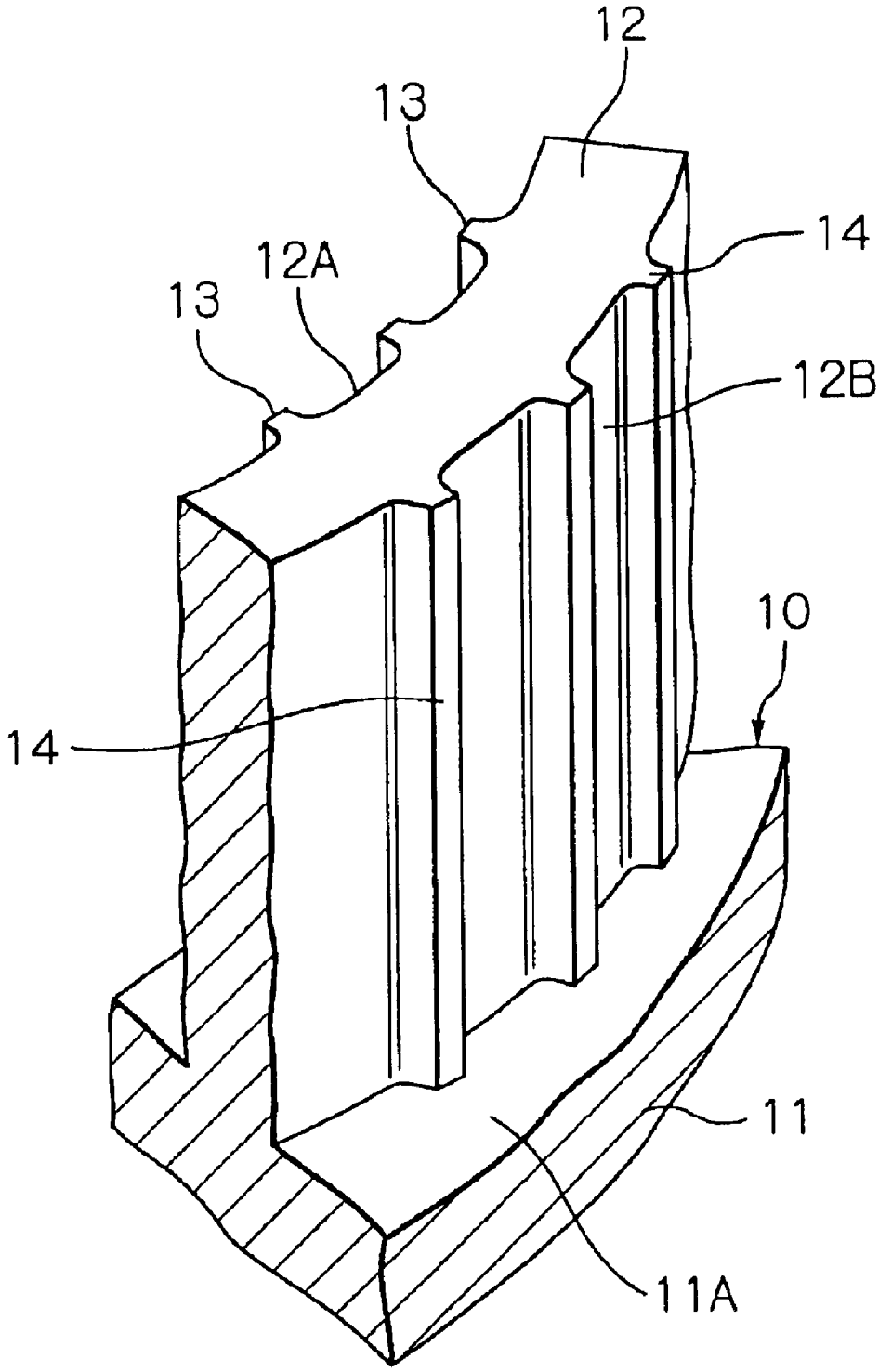
FIG. 4 is a partially-cutaway enlarged perspective view showing an end plate, wrap portion, inner peripheral projections and outer peripheral projections of the orbiting scroll member.
Figure 5:
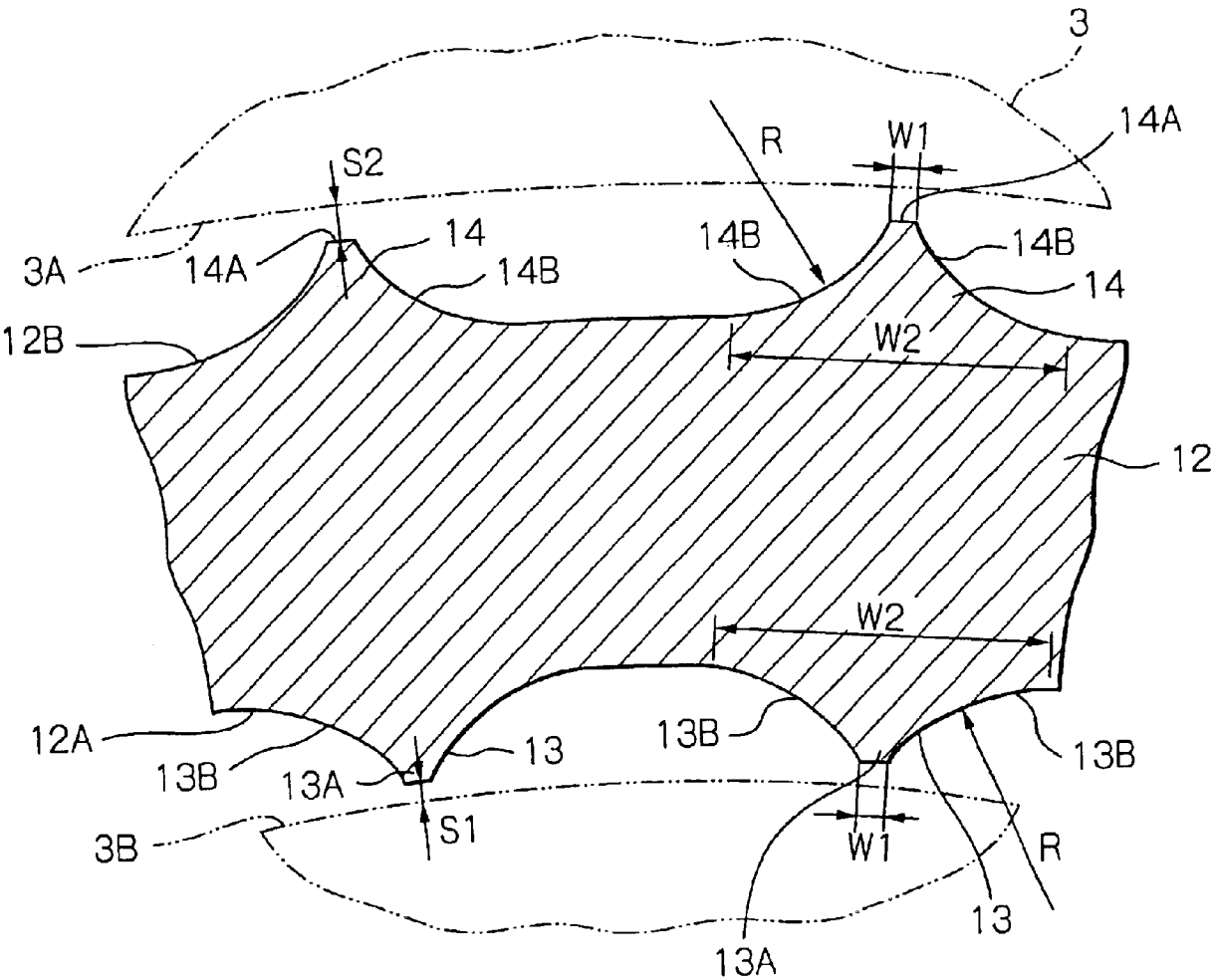
FIG. 5 is an enlarged fragmentary transverse sectional view showing the wrap portion, inner peripheral projections and outer peripheral projections of the orbiting scroll member.

As shown in FIGS. 3 and 4, the inner peripheral projections 13 provided on the inner peripheral surface 12A of the wrap portion 12 extend axially at spacings in the spiral direction (longitudinal direction, i.e. circumferential direction) of the wrap portion 12. As shown in FIG. 5, each inner peripheral projection 13 has an approximately triangular transverse sectional configuration defined by a top 13A with a narrow width and a pair of concavely arcuate surfaces 13B forming left and right slopes that connect the top 13A to the inner peripheral surface 12A of the wrap portion 12. Each concavely arcuate surface 13B extends smoothly from the top 13A to the inner peripheral surface 12A of the wrap portion 12.

The outer peripheral projections 14 are provided on the outer peripheral surface 12B of the wrap portion 12 to extend axially at spacings in the spiral direction of the wrap portion 12. The outer peripheral projections 14 have a configuration approximately similar to that of the inner peripheral projections 13. That is, each outer peripheral projection 14 has an approximately triangular transverse sectional configuration defined by a top 14A and a pair of concavely arcuate surfaces 14B forming left and right slopes.

Now, there will be given a detailed description of the configuration, positional relationship and so forth of the inner peripheral projections 13 provided on the inner peripheral surface 12A of the wrap portion 12 of the orbiting scroll member 10.

First, the radius R of the concavely arcuate surfaces 13B constituting the inner peripheral projections 13 of the wrap portion 12 is set not less than ¼ times the radial turn spacing T of the wrap portion 12 and not more than one time the radial turn spacing T as given by the following expression (1):

$$\tfrac{1}{4}\times T \leqq R \leqq T \tag{1}$$

In the range of R given by the above expression (1), a value in the range given by the following expression (2) is even more desirable:

$$\tfrac{2}{5}\times T \leqq R \leqq \tfrac{3}{5}\times T \tag{2}$$

Thus, when the inner peripheral surface 12A of the wrap portion 12 is cut, the inner peripheral projections 13 can be formed at the same time continuously by using the same cutting tool, for example, an end mill, as used to machine the wrap portion 12. Further, the concavely arcuate surfaces 13B prevent stress concentration, thereby allowing the mechanical strength at the tops 13A to be increased.

It should be noted that each concavely arcuate surface 13B may be formed from a single circular arc having a radius R in the range of from not less than ¼ times the radial turn spacing T to not more than one time the radial turn spacing T. It is also possible to form each concavely arcuate surface 13B by connecting together a plurality of circular arcs having a radius R not less than ¼ times the radial turn spacing T into a complex concave surface having a general curvature radius not less than ¼ times the radial turn spacing T.

Figure 8:
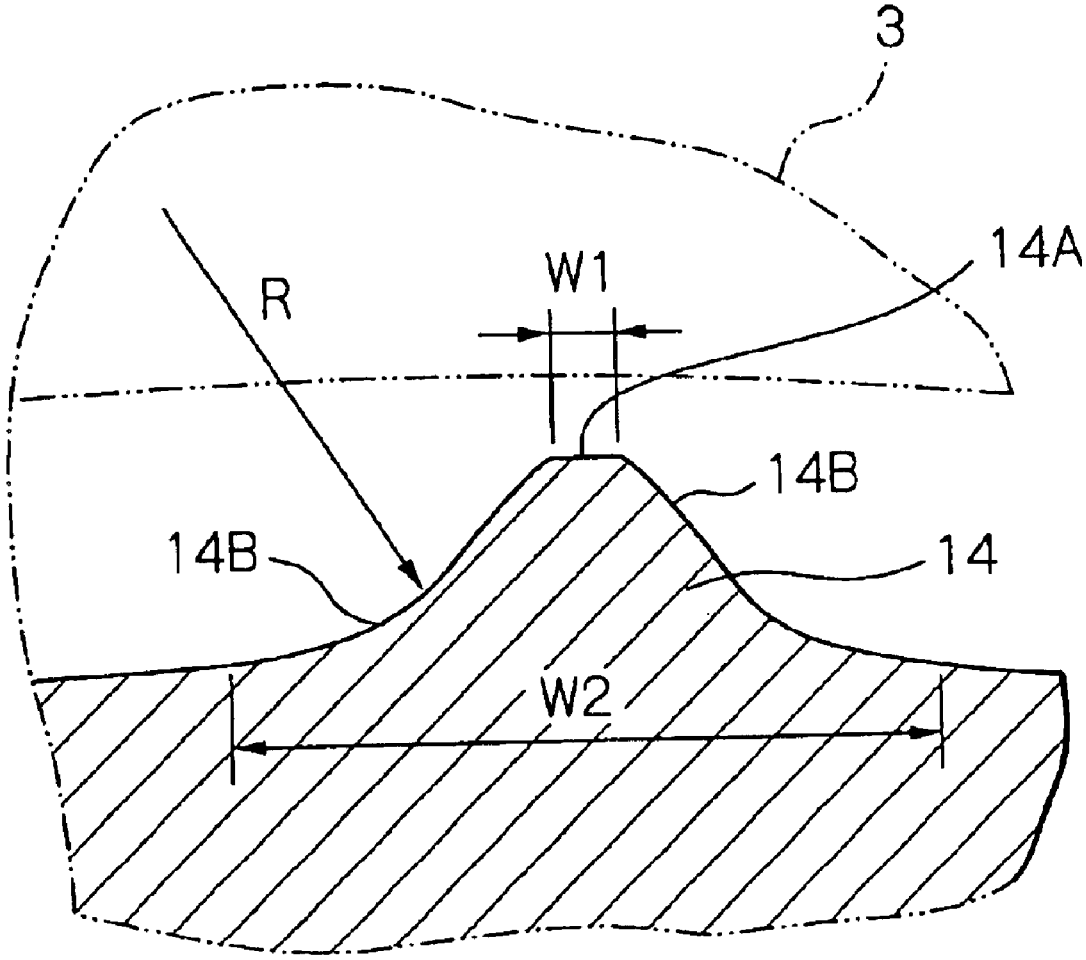
FIG. 8 is an enlarged fragmentary transverse sectional view showing another example of the configuration of the projections shown in FIG. 5.

Although the transverse sectional configuration of each projection in FIG. 5 has been described above such that the slopes connecting the top to the peripheral surface are concavely arcuate surfaces, by way of example, the present invention is not necessarily limited to the described configuration. It is necessary to use concave surfaces only at the points of contact between the peripheral surface and the slopes. For example, the configuration may be as shown in FIG. 8, in which only the areas around the points of contact between the peripheral surface and the slopes are concave surfaces, and the areas around the points of contact between the top and the slopes are convex surfaces.

Assuming that the width of the top 13A of each inner peripheral projection 13 is W1 and the overall width of the concavely arcuate surfaces 13B is W2 (overall width of the projection 13), the width W2 is set as given by the following expression (3):

$$W2 \geqq W1\times 2 \tag{3}$$

Consequently, the concavely arcuate surfaces 13B of each inner peripheral projection 13 have substantial dimensions in the circumferential direction. Thus, the inner peripheral projections 13 have sufficiently high mechanical strength to prevent damage thereto even when contacting the wrap portion 3 of the fixed scroll member 1.

The width W1 of the top 13A of each inner peripheral projection 13 is set as given by the following expression (4):

$$0\ \text{mm} \leqq W1 \leqq 2\ \text{mm} \tag{4}$$

In the range of W1 given by the above expression (4), a value in the range given by the following expression (5) is even more desirable for obtaining even more favorable compression performance:

$$0.1\ \text{mm} \leqq W1 \leqq 0.3\ \text{mm} \tag{5}$$

Thus, the tops 13A with a narrow width can readily be crushed or worn when contacting the opposing outer peripheral surface 3B of the wrap portion 3 of the fixed scroll member 1. By being crushed or worn in this way, the tops 13A can become fit to the outer peripheral surface 3B of the wrap portion 3 without strongly contacting it many times.

On the other hand, the pitch P of the inner peripheral projections 13 in the spiral direction of the wrap portion 12, i.e. in the longitudinal direction thereof, is set so that the pitch P decreases gradually from the radially outer side toward the radially inner side. Let us give a detailed description of the arrangement of the inner peripheral projections 13. For the orbiting scroll member 10, as shown in FIG. 3, an evolute 101 with an evolute radius a centered at the center O2 (position of the axis O2—O2) of the orbiting scroll member 10 is obtained to trace the involute of the wrap portion 12. It should be noted that the evolute radius a is a value characteristic of the orbiting scroll member 10 determined by the orbiting radius δ and the thickness of the wrap portion 12 of the orbiting scroll member 10, which is a known term in association with involute curves.

Assuming that, of innumerable tangents to the evolute 101, an arbitrary tangent is L1 and other tangents offset successively from the tangent L1 by an angle α are L2, L3 and so forth, the inner peripheral projections 13 are positioned on the tangents L1, L2 and so forth, respectively.

In this embodiment, the angle α between each pair of adjacent tangents L1, L2 and so forth is set at about 10 degrees. Thus, the pitch P of the inner peripheral projections 13 in the spiral direction is narrow on the 1st turn of the wrap portion 12 at the radially inner end thereof but wide on the n th turn of the wrap portion 12 at the radially outer end thereof.

By setting the pitch P of the inner peripheral projections 13 narrow (small) at the radially inner side as stated above, the tops 13A of the inner peripheral projections 13 can be placed with a desired gap with respect to the opposing outer peripheral surface 3B of the wrap portion 3 even at a part where the radius of curvature of the wrap portion 3 is small and hence the curvature of the wrap portion 3 is steep.

The inner peripheral projections 13 are formed on the inner peripheral surface 12A over the entire length of the wrap portion 12 in the spiral direction except for about a half turn of the wrap portion 12 from the spiral starting end, that is, the radially inner end of the wrap portion 12. The part of the inner peripheral surface 12A of the wrap portion 12 that extends over about a half turn from the spiral starting end of the wrap portion 12 has the smallest radius of curvature and exhibits a minimal change in dimension with heat. Therefore, the associated compression chamber 15 can be hermetically sealed satisfactorily without the need to provide inner peripheral projections 13. Accordingly, this part of the inner peripheral surface 12A is formed as a smooth surface.

Further, the gap S1 defined between the top 13A of each inner peripheral projection 13 and the opposing outer peripheral surface 3B of the wrap portion 3 of the fixed scroll member 1 when the inner peripheral projections 13 approach the outer peripheral surface 3B is set smaller than the gap S2 defined between the top 14A of each outer peripheral projection 14 (described later) and the opposing inner peripheral surface 3A of the wrap portion 3 of the fixed scroll member 1 when the outer peripheral projections 14 approach the inner peripheral surface 3A as given by the following expression (6):

$$S1<S2 \tag{6}$$

Because the gap S1 between each inner peripheral projection 13 and the wrap portion 3 is set smaller than the gap S2 between each outer peripheral projection 14 and the wrap portion 3, when contact occurs between the wrap portions 3 and 12, the inner peripheral projections 13 (inner peripheral surface 12A) provided on the wrap portion 12 of the orbiting scroll member 10 can be brought into contact with the outer peripheral surface 3B of the wrap portion 3 of the fixed scroll member 1 before the outer peripheral projections 14 contact the inner peripheral surface 3A of the wrap portion 3.

When the inner peripheral projections 13 of the wrap portion 12 of the orbiting scroll member 10 contact the wrap portion 3 of the fixed scroll member 1 before the outer peripheral projections 14 contact the wrap portion 3, force acts on the orbiting scroll member 10 in such a manner that the contact portions serve as fulcrums, causing the orbiting scroll member 10 to rotate in the same direction as that of rotating force. Thus, the orbiting scroll member 10 is pressed in the direction of rotating force. Accordingly, it is possible to eliminate backlash in a rotation preventing mechanism (not shown) provided between the orbiting scroll member 10 and the casing, for example.

The outer peripheral projections 14 provided on the outer peripheral surface 12B of the wrap portion 12 of the orbiting scroll member 10 are formed under conditions similar to those concerning the configuration, positional relationship and so forth of the inner peripheral projections 13 described above. Therefore, a description thereof is omitted.

The scroll air compressor according to this embodiment has the above-described arrangement. Next, the operation of the scroll air compressor will be described.

First, when the driving shaft 8 is driven to rotate by a driving source (not shown), e.g. an electric motor, the orbiting scroll member 10 performs an orbiting motion with an orbiting radius δ about the axis O1—O1 of the driving shaft 8 in the state of being prevented from rotating around its own axis by the rotation preventing mechanism. The compression chambers 15, which are defined between the wrap portion 3 of the fixed scroll member 1 and the wrap portion 12 of the orbiting scroll member 10, are successively contracted by the orbiting motion of the orbiting scroll member 10. Thus, the air sucked in from the suction opening 6 of the fixed scroll member 1 is successively compressed in the compression chambers 15, and the compressed air is discharged from the discharge opening 7 of the fixed scroll member 1 to an external tank (not shown).

According to the foregoing embodiment, the wrap portion 12 of the orbiting scroll member 10 is provided with a plurality of inner peripheral projections 13 on the inner peripheral surface 12A and a plurality of outer peripheral projections 14 on the outer peripheral surface 12B. The inner peripheral projections 13 and the outer peripheral projections 14 each have an approximately triangular transverse sectional configuration defined by a top 13A (14A) with a narrow width and a pair of concavely arcuate surfaces 13B (14B) having substantial dimensions in the circumferential direction. The concavely arcuate surfaces 13B smoothly connect the top 13A and the inner peripheral surface 12A of the wrap portion 12. Similarly, the concavely arcuate surfaces 14B smoothly connect the top 14A and the outer peripheral surface 12B of the wrap portion 12.

Accordingly, the inner peripheral projections 13 and the outer peripheral projections 14 allow the tops 13A and 14A to connect smoothly with the inner peripheral surface 12A and the outer peripheral surface 12B of the wrap portion 12 through the concavely arcuate surfaces 13B and 14B, respectively. Consequently, it is possible to prevent stress concentration and hence possible to increase the mechanical strength at the tops 13A and 14A. It is also possible to carry out machining easily by using a tool, e.g. an end mill. Further, because the inner peripheral projections 13 and the outer peripheral projections 14 have an approximately triangular transverse sectional configuration, high mechanical strength can be obtained.

As a result, the inner peripheral projections 13 and the outer peripheral projections 14 can exhibit increased rigidity and resistance to damage due to contact and vibration, deterioration with age, etc. Therefore, durability and reliability can be improved.

Moreover, the inner peripheral projections 13 and the outer peripheral projections 14 have the tops 13A and 14A formed with a narrow width. Therefore, when contacting the opposing wrap portion 3, the tops 13A and 14A can readily be crushed or worn. Thus, the tops 13A and 14A of the inner and outer peripheral projections 13 and 14 can become fit to the wrap portion 3 without strongly contacting it many times. Accordingly, it is possible to prevent power loss, noise generation, scoring, etc.

Further, the radius R of the concavely arcuate surfaces 13B and 14B of the inner and outer peripheral projections 13 and 14 is set not less than ¼ times the radial turn spacing T of the wrap portion 12 and not more than one time the radial turn spacing T as given by the expression (1), preferably not less than ⅖ times the radial turn spacing T and not more than ⅗ times the radial turn spacing T as given by the expression (2). Accordingly, the inner peripheral projections 13 and the outer peripheral projections 14 can be formed by using the same cutting tool, e.g. an end mill, as used to cut the inner peripheral surface 12A and the outer peripheral surface 12B of the wrap portion 12. Thus, it is possible to facilitate the machining operation and to achieve an improvement in productivity and a cost reduction.

The width W2 of the concavely arcuate surfaces 13B and 14B of the inner and outer peripheral projections 13 and 14 is set not less than 2 times the width W1 of the tops 13A and 14A as given by the expression (3). Accordingly, the inner peripheral projections 13 and the outer peripheral projections 14 can be formed with a sufficiently wide width at the root side thereof. Thus, the mechanical strength can be further increased.

The width W1 of the tops 13A and 14A of the inner and outer peripheral projections 13 and 14 is set not less than 0 mm and not more than 2 mm as given by the expression (4), preferably not less than 0.1 mm and not more than 0.3 mm as given by the expression (5). Therefore, when contacting the opposing wrap portion 3, the tops 13A and 14A can readily be crushed or worn. Thus, the tops 13A and 14A can become fit to the wrap portion 3 without strongly contacting it many times. Accordingly, it is possible to surely prevent power loss, noise generation, scoring, etc.

Meanwhile, each pair of adjacent inner peripheral projections 13 are disposed at an angular spacing a, e.g. 10 degrees, and so are each pair of adjacent outer peripheral projections 14, whereby the pitch P of the inner peripheral projections 13 and the outer peripheral projections 14 in the spiral direction is made narrow at the radially inner side but wide at the radially outer side. Accordingly, even a radially inner part of the wrap portion 3 where the radius of curvature of the wrap portion 3 is small and hence the curvature thereof is steep can be provided with inner peripheral projections 13 and outer peripheral projections 14 with a narrowed pitch P in the spiral direction close to each other along the outer peripheral surface 3B and the inner peripheral surface 3A of the wrap portion 3. Thus, the degree of hermeticity in the compression chambers 15 there can be increased, and the compression performance can be improved.

Further, the inner peripheral projections 13 and the outer peripheral projections 14 are formed over the entire length of the wrap portion 12 in the spiral direction except for about a half turn of the wrap portion 12 from the spiral starting end. Therefore, the inner peripheral projections 13 and the outer peripheral projections 14 can be provided only on a part of the wrap portion 12 where the projections 13 and 14 are needed. Accordingly, the machining operation can be simplified.

Further, the gap S1 defined between the top 13A of each inner peripheral projection 13 and the mating outer peripheral surface 3B of the wrap portion 3 and the gap S2 defined between the top 14A of each outer peripheral projection 14 and the mating inner peripheral surface 3A of the wrap portion 3 are set so as to satisfy the relationship of S1<S2 as given by the expression (6). Therefore, when contact occurs between the wrap portions 3 and 12, the inner peripheral projections 13 provided on the wrap portion 12 of the orbiting scroll member 10 can be brought into contact with the outer peripheral surface 3B of the wrap portion 3 of the fixed scroll member 1 before the outer peripheral projections 14 contact the inner peripheral surface 3A of the wrap portion 3. Accordingly, the orbiting scroll member 10 can be rotated in the same direction as that of rotating force with the contact portions serving as fulcrums. Thus, it is possible to eliminate backlash in the rotation preventing mechanism (not shown), etc. and hence possible to improve the compression performance.

Next, a second embodiment of the present invention will be described with reference to FIGS. 6-A and 6-B. It should be noted that in this embodiment the same constituent elements as those in the first embodiment are denoted by the same reference characters, and a description thereof is omitted.

When the orbiting scroll member 12 performs an orbiting motion with respect to the fixed scroll member 1, some outer peripheral projections 18 of the fixed scroll member 1 and the inner peripheral surface 14A (step portion 23, described later) of the wrap portion 14 of the orbiting scroll member 12 come closest to each other or in contact with each other, and these portions closest to (or in contact with) each other are placed in a trapping position for trapping air in the compression chambers 17. The fixed-side outer peripheral projections 18 reduce the gap between the outer peripheral surface 19 of the wrap portion 3 and the inner peripheral surface 14A of the wrap portion 14 at the trapping position of the compression chambers 17, thereby increasing the degree of hermeticity in the compression chambers 17.

The top 18A of each fixed-side outer peripheral projection 18 is formed so as to face the step portion 23 of the wrap portion 14 (described later) with a gap δ1 at the trapping position of the compression chambers 17. Grooves 19 between the adjacent fixed-side outer peripheral projections 18 are formed so as to face the step portion 23 of the wrap portion 14 with a gap δ2 at the trapping position of the compression chambers 17. Further, an outer peripheral surface 3B located on the foot side of the wrap portion 3 is formed so as to face the inner peripheral surface 14A of the wrap portion 14 with a gap δ3 at the trapping position of the compression chambers 17 (see FIG. 6-A). The gap δ3 between the outer peripheral surface 3B and the inner peripheral surface 14A is set smaller than the gap δ2 but larger than the gap δ1 (δ1<δ3<δ2).

A step portion 20 is provided on the foot side of the wrap portion 3 of the fixed scroll member 1. With the step portion 20, the foot side of the wrap portion 3 is wider in width than the distal side thereof. The step portion 20 is formed so that the inner peripheral surface 3A projects by a dimension t toward the mating outer peripheral surface 14B of the wrap portion 14 of the orbiting scroll member 12. The step portion 20 extends axially with a length approximately equal to the length of orbiting-side outer peripheral projections 21 (described later) of the wrap portion 14 to face the orbiting-side outer peripheral projections 21.

A plurality of orbiting-side outer peripheral projections 21 are provided on the outer peripheral surface 14B of the wrap portion 14 of the orbiting scroll member 12. The orbiting-side outer peripheral projections 21 come closest to the inner peripheral surface 3A (step portion 20) of the wrap portion 3 of the fixed scroll member 1 at the trapping position of the compression chambers 17, thereby reducing the gap between the inner peripheral surface 3A of the wrap portion 3 and the outer peripheral surface 14B of the wrap portion 14.

The orbiting-side outer peripheral projections 21 extend from the distal end toward the foot portion of the wrap portion 14 to a halfway position in the axial direction. In other words, the orbiting-side outer peripheral projections 21 are formed axially only on an distal-side part of the wrap portion 14 away from the end plate 13 in substantially the same way as in the case of the fixed-side outer peripheral projections 18. In addition, grooves 22 are formed between the adjacent orbiting-side outer peripheral projections 21. Of the outer peripheral surface 14B of the wrap portion 14, a part located on the foot side of the wrap portion 14 (i.e. a part of the wrap portion 14 other than the orbiting-side outer peripheral projections 21 and the grooves 22) is formed as a smooth curved surface without a recess or a projection.

The orbiting-side outer peripheral projections 21 have an approximately triangular transverse sectional configuration, for example, substantially similar to that of the fixed-side outer peripheral projections 18, and are formed with geometric dimensions (widths W1, W2, radius R, etc.) approximately equal to those of the fixed-side outer peripheral projections 18. Accordingly, at the trapping position of the compression chambers 17, for example, a gap δ1 is formed between the top of each orbiting-side outer peripheral projection 21 and the step portion 20 of the wrap portion 3, and a gap δ2 is formed between each groove 22 and the step portion 20. In addition, a gap δ3 is formed between the outer peripheral surface 14B of the wrap portion 14 and the inner peripheral surface 3A of the wrap portion 3.

A step portion 23 is provided on the foot side of the wrap portion 14 of the orbiting scroll member 12. With the step portion 23, the foot side of the wrap portion 14 is wider in width than the distal side thereof, and the inner peripheral surface 14A projects by a dimension t toward the mating outer peripheral surface 3B of the wrap portion 3 of the fixed scroll member 1, approximately in the same way as the step portion 20 of the wrap portion 3. The step portion 23 extends axially with a length approximately equal to the length of the fixed-side outer peripheral projections 18 of the wrap portion 3 to face the fixed-side outer peripheral projections 18.

The operation of the second embodiment will be described below.

As shown in a first comparative example illustrated in FIG. 6-C, if neither the wrap portion 103 of the fixed scroll member 101 nor the wrap portion 104 of the orbiting scroll member 102 is provided with outer peripheral projections, a minimal gap δ3 is formed between the wrap portions 103 and 104 at the trapping position to prevent contact between the wrap portions 103 and 104.

As shown in a second comparative example illustrated in FIG. 6-D, if outer peripheral projections 105 and 106 are provided on the outer peripheral surfaces 103B and 104B of the wrap portions 103 and 104 over the entire axial length thereof, the gap between the top of each outer peripheral projection 105 (106) and the mating inner peripheral surface 104A (103A) of the wrap portion 104 (103) can be set at a dimension δ1, which is smaller than the gap δ3 in the first comparative example. In this case, however, the gap between the outer peripheral surface 103B (104B) exclusive of the outer peripheral projections 105 (106) and the mating inner peripheral surface 104A (103A) of the wrap portion 104 (103) becomes a gap δ2, which is larger than the gap δ3 owing to the formation of the outer peripheral projections 105 (106). Thus, the average radial gap undesirably increases as a whole.

In contrast to the comparative examples, the embodiment shown in FIG. 6-A has the outer peripheral projections 18 and 21 only on the distal sides of the outer peripheral surfaces 3B and 14B of the wrap portions 3 and 14. In addition, the step portions 23 and 20 are formed on the foot sides of the inner peripheral surfaces 14A and 3A of the wrap portions 14 and 3 opposing the outer peripheral projections 18 and 21 such that the step portions 23 and 20 project by a dimension t. Accordingly, at the distal side, the gap between each outer peripheral projection 18 (21) and the step portion 23 (20) can be set at a dimension δ1, which is approximately equal to that in the second comparative example. At the foot side, the gap between the outer peripheral surface 3B (14B) and the inner peripheral surface 14A (3A) can be set at a dimension δ3, which is approximately equal to that in the first comparative example. As a result, the average radial gap can be reduced in comparison to the second comparative example, and hence the compression efficiency can be increased.

Thus, in this embodiment, the outer peripheral projections 18 and 21 are formed only on respective limited axial regions of the wrap portions 3 and 14 away from the end plates 2 and 13. Therefore, it is possible to reduce the axial lengths of the outer peripheral projections 18 and 21 and hence possible to minimize noise generated by the projections 18 and 21.

In addition, the grooves 19 and 22 between the adjacent projections 18 and 21 can be reduced in length in the axial direction of the wrap portions 3 and 14 in comparison to the second comparative example. Therefore, the average radial gap between the wrap portion 3 of the fixed scroll member 1 and the wrap portion 14 of the orbiting scroll member 12 can be reduced, and hence the compression efficiency can be increased. Further, as the compression efficiency increases, the temperature in the wrap portions 3 and 14 can be lowered. Accordingly, the lifetime of tip seals 24 and 25, etc. can be increased.

Further, at the foot side, the gap between the outer peripheral surface 3B (14B) of the wrap portion 3 (14) and the mating inner peripheral surface 14A (3A) of the wrap portion 14 (3) can be set approximately equal to the gap δ3 formed when no projections are provided as in the first comparative example. Therefore, it is possible to prevent contact between the wrap portions 3 and 14 at this region. Thus, reliability can be improved.

Particularly, in this embodiment, the outer peripheral projections 18 and 21 are formed only on the respective distal regions of the wrap portions 3 and 14. Thus, the outer peripheral projections 18 and 21 can be disposed only on the distal regions of the wrap portions 3 and 14 where thermal tilt of the wrap portions 3 and 4 (tilting of the wrap portions based on strain in the whole scroll due to the influence of heat) may occur remarkably. Consequently, it is possible to allow the outer peripheral projections 18 and 21 to come closest to the mating wrap portions 14 and 3 or contact them, respectively, while preventing scoring due to thermal tilt. Accordingly, the compression efficiency can be further increased. Further, because neither of the foot sides of the wrap portions 3 and 14 are provided with outer peripheral projections 18 and 21, it is possible to reduce the areas of the wrap portions 3 and 14 that need to be cut in comparison to a case where projections are provided on the wrap portions over the entire axial length thereof as in the second comparative example. Accordingly, the machining cost can be reduced, and the dimensional control at the foot side can be facilitated.

Further, because the fixed-side outer peripheral projections 18 are provided on the wrap portion 3 of the fixed scroll member 1 and the orbiting-side outer peripheral projections 21 are provided on the wrap portion 14 of the orbiting scroll member 12, the outer peripheral projections 18 and 21 can be brought closest to the mating smooth inner peripheral surfaces 14A and 3A (step portions 20 and 23) of the wrap portions 14 and 3. Accordingly, it is possible to prevent contact between projections, hence, scoring, and so forth due to contact between projections.

Next, a third embodiment of the present invention will be described with reference to FIG. 7. It should be noted that in this embodiment the same constituent elements as those in the first embodiment are denoted by the same reference characters, and a description thereof is omitted.

Figure 7:
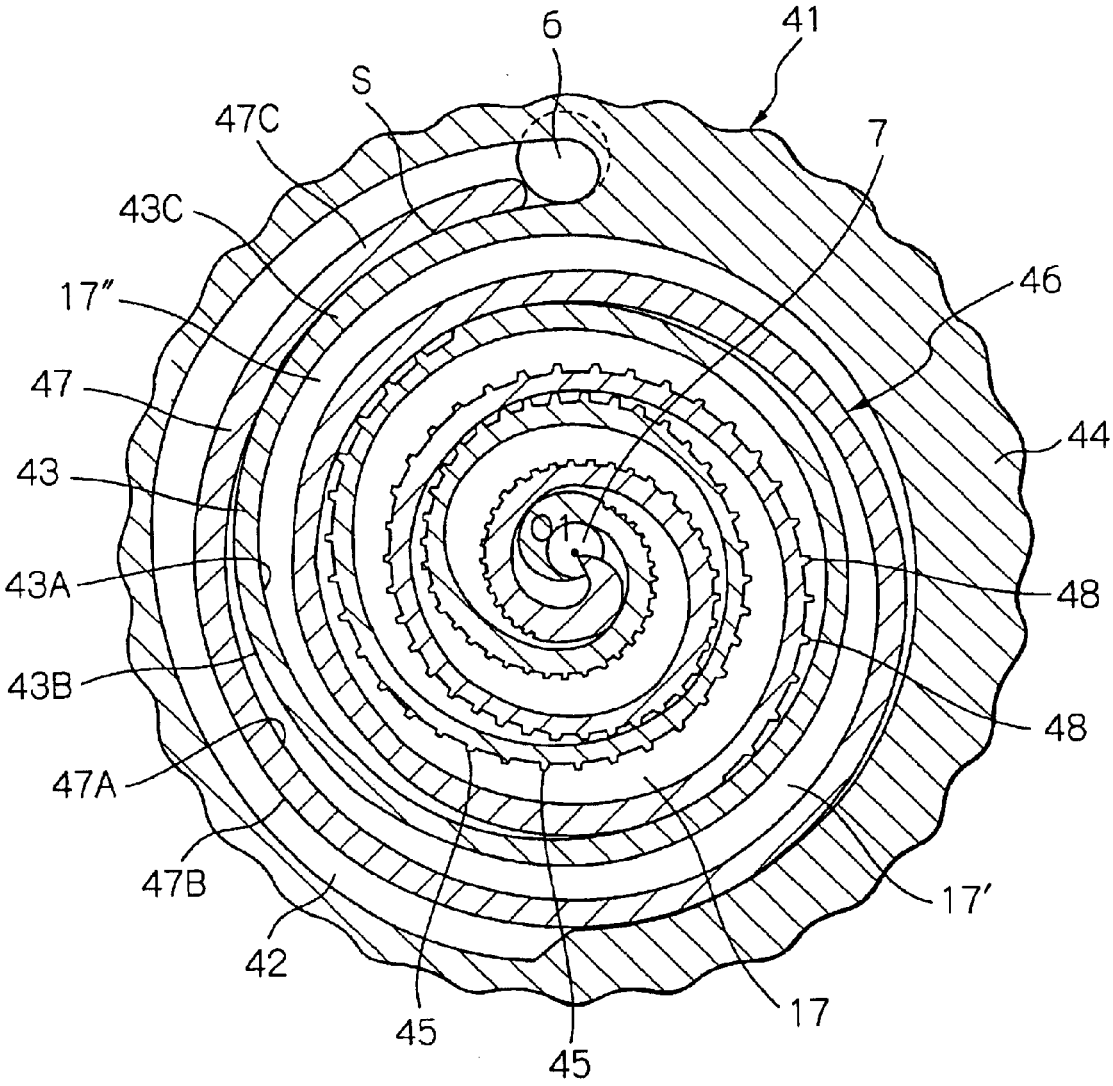
FIG. 7 is a transverse sectional view showing a scroll air compressor according to a third embodiment of the present invention.

As shown in FIG. 7, a fixed scroll member 41 of a scroll air compressor has an end plate 42, a wrap portion 43, a cylindrical portion 44, a flange portion (not shown), and so forth substantially in the same way as in the first embodiment. The wrap portion 43 is formed in a spiral shape having an inner peripheral surface 43A and an outer peripheral surface 43B.

The outer peripheral surface 43B of the wrap portion 43 is provided with fixed-side outer peripheral projections 45 extending over the entire axial length of the wrap portion 43. At the radially outer side (spiral terminating end side) of the wrap portion 43, a non-projection forming region 43C is provided where no fixed-side outer peripheral projections 45 are formed. The non-projection forming region 43C extends over a length corresponding to approximately one turn of the wrap portion 43 from the radially outer end thereof toward the radially inner side, for example. The non-projection forming region 43C is a part of the wrap portion 43 that forms peripheral walls of the radially outer compression chambers 17' and 17".

An orbiting scroll member 46 is disposed to face the fixed scroll member 41. The orbiting scroll member 46 has a spiral wrap portion 47 standing on an end plate (not shown), and the wrap portion 47 has an inner peripheral surface 47A and an outer peripheral surface 47B, substantially in the same way as in the first embodiment.

The outer peripheral surface 47B of the wrap portion 47 is provided with orbiting-side outer peripheral projections 48 extending over the entire axial length of the wrap portion 47. At the radially outer side (spiral terminating end side) of the wrap portion 47, a non-projection forming region 47C is provided where no orbiting-side outer peripheral projections 48 are formed, substantially in the same way as the wrap portion 43 of the fixed scroll member 41. The non-projection forming region 47C extends over a length corresponding to approximately one and a half turns of the wrap portion 47 from the radially outer end thereof toward the radially inner side, for example. The non-projection forming region 47C is a part of the wrap portion 47 that forms peripheral walls of the radially outer compression chambers 17' and 17".

In the third embodiment arranged as stated above, a radially outer end part of the wrap portion 43 of the fixed scroll member 41 that corresponds to approximately one turn of the wrap portion 43 is defined as a non-projection forming region 43C, and a radially outer end part of the wrap portion 47 of the orbiting scroll member 46 that corresponds to approximately one and a half turns of the wrap portion 47 is defined as a non-projection forming region 47C. Therefore, it is possible to favorably maintain the sealing performance required for the compression chamber 17' located at the compression starting position S and also the sealing performance required for the compression chamber 17" adjacent to the compression chamber 17'. Accordingly, it is possible to stably compress air in the compression chambers 17' and 17" at the radially outer side that have a significant effect on the volumetric efficiency during air compression. Consequently, the compression performance can be improved. In addition, noise generated by the projections 45 and 48 at the radially inner side can be prevented from leaking to the outside through the suction opening 6. Thus, noise can be reduced.

It should be noted that in the first embodiment the present invention has been described with regard to an example in which the inner peripheral projections 13 are provided on the inner peripheral surface 12A of the wrap portion 12 constituting the orbiting scroll member 10 and the outer peripheral projections 14 are provided on the outer peripheral surface 12B of the wrap portion 12. However, the present invention is not necessarily limited to the described arrangement. For example, projections may be provided on both the inner peripheral surface 3A and the outer peripheral surface 3B of the wrap portion 3 of the fixed scroll member 1. It is also possible to provide projections on the inner peripheral surface 3A of the wrap portion 3 of the fixed scroll member 1 and on the inner peripheral surface 12A of the wrap portion 12 of the orbiting scroll member 10. The arrangement may also be such that projections are provided on the outer peripheral surface 3B of the wrap portion 3 of the fixed scroll member 1 and on the outer peripheral surface 12B of the wrap portion 12 of the orbiting scroll member 10.

Further, in the foregoing first embodiment, the inner peripheral projections 13 provided on the inner peripheral surface 12A of the wrap portion 12 of the orbiting scroll member 10 and the outer peripheral projections 14 provided on the outer peripheral surface 12B thereof are disposed in the orbiting direction at angular spacings $\alpha$ of 10 degrees, by way of example. However, the present invention is not necessarily limited to the described arrangement. The inner peripheral projections 13 and the outer peripheral projections 14 may be disposed in a staggered arrangement by positioning the projections 13 and 14 at respective angular spacings of about 20 degrees such that the projections 13 and 14 alternate with each other in the orbiting direction with an offset angle of about 10 degrees.

In the foregoing embodiments, the present invention has been described with regard to a scroll air compressor as an example of the scroll fluid machine, in which an orbiting scroll member 10 performs an orbiting motion with respect to a fixed scroll member 1 secured to a casing. However, the present invention is not necessarily limited to the described scroll air compressor but may also be applied to a full-rotating type scroll fluid machine, for example, in which two scrolls disposed facing each other are driven to rotate, respectively, as disclosed in Japanese Patent Application Unexamined Publication (KOKAI) No. Hei 9-133087 such that the same relative positional relationship as that in the foregoing embodiments in attained.

Further, although in the foregoing embodiments the present invention has been described with regard to a scroll air compressor as an example of the scroll fluid machine, the present invention is not necessarily limited thereto but may also be applied to other scroll fluid machines, e.g. a refrigerant compressor for compressing a refrigerant.

As has been detailed above, a feature of the present invention resides in that a peripheral surface of the wrap portion of at least one scroll member is provided with a plurality of axially extending projections at spacings in the spiral direction of the wrap portion. Each projection has a transverse sectional configuration defined by a top of the projection and slopes connecting the top to the peripheral surface of the wrap portion. Each slope has a concave surface at a portion thereof that is contiguous to the peripheral surface.

With the above-described arrangement, each projection is formed in an approximately triangular transverse sectional configuration. Therefore, it is possible to prevent stress concentration and to increase the mechanical strength at the tops of the projections. In addition, machining can be readily carried out by using a tool, e.g. an end mill. On the other hand, when contacting the opposing peripheral surface of the wrap portion of the other scroll member, the tops of the projections are readily crushed or worn. Therefore, the tops of the projections can become fit to the opposing peripheral surface of the wrap portion without strongly contacting it many times.

Another feature of the present invention resides in that the concave surface of each projection formed on the wrap portion has a curvature radius not less than that of a circular arc having a radius ¼ times the radial turn spacing T of the wrap portion.

With the above-described arrangement, the projections can be formed with the same tool, e.g. an end mill, as used to cut the peripheral surface of the wrap portion. That is, the projections can be formed when cutting the peripheral surface of the wrap portion by using the same tool, e.g. an end mill, without the need for tool change.

Another feature of the present invention resides in that the projections satisfy the condition of $W1 \times 2 \leqq W2$, where W1 is the width of the top of each projection, and W2 is the overall width of the projection. Accordingly, the projections are widened at the root side thereof. Thus, the mechanical strength of the projections can be increased.

Another feature of the present invention resides in that the pitch of the projections in the spiral direction is narrow at the radially inner side but wide at the radially outer side.

With the above-described arrangement, a radially inner part of the wrap portion where the radius of curvature of the wrap portion is small and hence the curvature thereof is steep can be provided with a plurality of projections with a narrowed pitch along the steep curvature.

Another feature of the present invention resides in that the projections are formed at approximately equal angular spacings throughout the wrap portion from the radially inner side to the radially outer side.

With the above-described arrangement, the pitch of the projections in the spiral direction becomes narrow at the radially inner side but wide at the radially outer side. Thus, a radially inner part of the wrap portion where the radius of curvature of the wrap portion is small and hence the curvature thereof is steep can be provided with a plurality of projections with a narrowed pitch along the steep curvature.

Another feature of the present invention resides in that the projections are provided only on either one of the mutually opposing inner and outer peripheral surfaces of the wrap portions of the one scroll member and the other scroll member. Accordingly, the projections can be disposed to face a smooth peripheral surface of the mating wrap portion.

Another feature of the present invention resides in that the projections are provided in any one manner selected from among a manner in which the projections are provided on the inner peripheral surface and the outer peripheral surface of the wrap portion of one scroll member, a manner in which the projections are provided on the inner peripheral surface and the outer peripheral surface of the wrap portion of the other scroll member, a manner in which the projections are provided on the inner peripheral surface of the wrap portion of one scroll member and on the inner peripheral surface of the wrap portion of the other scroll member, and a manner in which the projections are provided on the outer peripheral surface of the wrap portion of one scroll member and on the outer peripheral surface of the wrap portion of the other scroll member. In any of these cases, the projections can be disposed to face a smooth peripheral surface of the mating wrap portion.

Another feature of the present invention resides in that the top of each projection has a width W1 in the range of $0\ \text{mm} \leqq W1 \leqq 2\ \text{mm}$. Accordingly, the tops of the projections can readily be crushed or worn when contacting the opposing peripheral surface of the wrap portion. Therefore, the tops of the projections can become fit to the opposing peripheral surface of the wrap portion without strongly contacting it many times.

Another feature of the present invention resides in that the inner peripheral-side gap S1 and the outer peripheral-side gap S2 defined when the top of each projection approaches the opposing peripheral surface of wrap portion satisfy the condition of $S1 < S2$.

With the above-described arrangement, when contact occurs between the radially opposing wrap portions, the inner peripheral surface of the wrap portion of the driving scroll member contacts the outer peripheral surface of the wrap portion of the fixed or follower scroll member before the outer peripheral surface of the former wrap portion contacts the inner peripheral surface of the latter wrap portion. Through this contact, force acts on the driving scroll member so as to rotate it in the same direction as that of rotating force. Thus, the driving scroll member is pressed in the direction of rotating force, so that backlash can be eliminated.

Another feature of the present invention resides in that the projections are provided on the wrap portion exclusive of the radially innermost part thereof. Accordingly, the projections can be provided only on a part of the entire length of the wrap portion where projections are needed to increase the degree of hermeticity in the compression chambers.

Another feature of the present invention resides in that the projections are formed only on a limited axial part of the wrap portion on the end plate away from the end plate.

With the above-described arrangement, for example, when one of the scroll members performs an orbiting motion, the projections on one scroll member can be brought closest to or into contact with the wrap portion of the other scroll member at the trapping position of the compression chambers. Thus, the degree of hermeticity in the compression chambers can be increased by the projections. Further, because the projections are formed only on a limited axial part of the wrap portion away from the end plate, the axial length of the projections can be reduced, and noise generated by the projections can be minimized.

Another feature of the present invention resides in that the projections are formed only on the radially inner part of the wrap portion in the spiral direction, and the wrap portion has a non-projection forming region at the radially outer end thereof.

With the above-described arrangement, for example, the smooth peripheral surfaces of the wrap portions can be brought closest to or into contact with each other at the trapping position of compression chambers defined at the radially outermost side of the wrap portion. Accordingly, it is possible to favorably seal the radially outer compression chambers that have a significant effect on the volumetric efficiency during compression.

Another feature of the present invention resides in that the non-projection forming region of the wrap portion is a part of the wrap portion corresponding to approximately one turn of the wrap portion that spirals radially inward from the compression starting position at which the wrap portion of one scroll member and the wrap portion of the other scroll member come closest to each other at the radially outermost side.

With the above-described arrangement, for example, the sealing performance required for the radially outer compression chambers at the compression starting position and so forth can be improved. Further, because the non-projection forming region is provided over a length corresponding to approximately one turn of the wrap portion from the compression starting position toward the radially inner side, the smooth peripheral surfaces of the wrap portions can surely be brought closest to or into contact with each other at one point on the radially outer side. Accordingly, noise generated by the projections at the radially inner side can be surely blocked at the point where the smooth peripheral surfaces come closest to or in contact with each other and thus prevented from leaking to the outside.

What is claimed is:

1. A scroll fluid machine comprising:

a first scroll member having a wrap portion projecting axially from an end plate, said wrap portion being wound spirally from a radially inner side toward a radial outer side of said end plate; and a second scroll member provided facing said first scroll member, said second scroll member having a wrap portion projecting axially from an end plate, said wrap portion being wound spirally from a radially inner side toward a radially outer side of said end plate so as to overlap the wrap portion of said first scroll member to define a plurality of compression chambers;

wherein at least one of said scroll members has on a peripheral surface of the wrap portion thereof a plurality of axially extending projections at spacings in a spiral direction of said wrap portion, said projections each having a transverse sectional configuration defined by a top of the projection and slopes connecting the top to said peripheral surface, each of said slopes having a concave surface at a portion thereof that is contiguous to said peripheral surface, and wherein said projections are provided only on either one of mutually opposing inner and outer peripheral surfaces of the wrap portions of said first and second scroll members and the other of said mutually opposing peripheral surfaces is a smooth surface without any projections or recesses.

2. A scroll fluid machine according to claim 1, wherein the concave surface of said projections has a radius of curvature not less than that of a circular arc having a radius ¼ times a radial turn spacing T of the wrap portion.

3. A scroll fluid machine according to claim 1, wherein a pitch of said projections in the spiral direction is narrow at the radially inner side but wide at the radially outer side.

4. A scroll fluid machine according to claim 1, wherein said projections are formed at approximately equal angular spacings throughout said wrap portion from the radially inner side to the radially outer side.

5. A scroll fluid machine according to claim 1, wherein said projections are provided in any one manner selected from among a manner in which said projections are provided on the inner peripheral surface and the outer peripheral surface of the wrap portion of said first scroll member, a manner in which said projections are provided on the inner peripheral surface and the outer peripheral surface of the wrap portion of said second scroll member, a manner in which said projections are provided on the inner peripheral surface of the wrap portion of said first scroll member and on the inner peripheral surface of the wrap portion of said second scroll member, and a manner in which said projections are provided on the outer peripheral surface of the wrap portion of said first scroll member and on the outer peripheral surface of the wrap portion of said second scroll member.

6. A scroll fluid machine according to claim 1, wherein the top of each of said projections has a width W1 in a range of 0 mm≦W1≦2 mm.

7. A scroll fluid machine according to claim 1, wherein said firsts oil member is a driven member end said second scroll member is a fixed one and said projections satisfy the following condition:

$$S1<S2$$

where S1 is a gap defined on the inner side of the wrap portion of the first scroll member between the top of each of the projections and the associated peripheral surface of the wrap portion when the projections approach the associated peripheral surface, and S2 is a gap defined on the outer side of the wrap portion of the first scroll member between the top of each of the projections and the associated peripheral surface of the wrap portion when the projections approach the associated peripheral surface.

8. A scroll fluid machine according to claim 1, wherein said projections are provided on said wrap portion exclusive of a radially innermost part thereof.

9. A scroll fluid machine according to claim 1, wherein said projections are formed only on a limited axial part of the wrap portion away from said end plate, with the surfaces of the tops of the projections being flush with the remaining peripheral surface of the wrap portion having no projections.

10. A scroll fluid machine according to claim 1, wherein said projections satisfy the following condition:

$$W1\times 2\leqq W2$$

where W1 is a width of said top, and W2 is an overall width of each of said projections.

11. A scroll fluid machine according to claim 10, wherein the top of each of said projections has a width W1 in a range of 0 mm≦W1≦2 mm.

12. A scroll fluid machine according to claim 1, wherein said projections are formed only on a radially inner part of said wrap portion in the spiral direction, and said wrap portion has a non-projection forming region at a radially outer end thereof.

13. A scroll fluid machine according to claim 12, wherein said non-projection forming region is a part of the wrap portion corresponding to approximately one turn of the wrap portion that spirals radially inward from a compression starting position at which the wrap portion of said first scroll member and the wrap portion of said second scroll member come closest to each other at a radially outermost side.

14. A scroll fluid machine comprising:

a first scroll member having a wrap portion projecting axially from a end plate, said wrap portion being wound spirally from a radially inner side toward a radially outer side of said end plate; and a second scroll member provided facing said first scroll member, said second scroll member having a wrap portion projecting axially from an end plate, said wrap portion being wound spirally from a radially inner side toward a radially outer side of said end plate so as to overlap the wrap portion of said first scroll member to define a plurality compression chambers;

wherein at least one of said scroll members has on a peripheral surface of the wrap portion thereof a plurality of axially extending projections at spacings in a spiral direction of said wrap portion, said projections each having a transverse sectional configuration defined by a top of the projection and slopes connecting the top to said peripheral surface, each of said slopes having a concave surface at a portion thereof that is contiguous to said peripheral surface, wherein said first scroll member is a driven member and said second scroll member is a fixed one and said projections satisfy the following condition:

$$S1 < S2$$

where S1 is a gap defined on the inner side of the wrap portion of the first scroll member between the top of each of the projections and the associated peripheral surface of the wrap portion when the projections approach the associated peripheral surface, and S2 is a gap defined on the outerside of the wrap portion of the first scroll member between the top of each of the projections and the associated peripheral surface of the wrap portion when the projections approach the associated peripheral surface.

15. A scroll fluid machine comprising:

a first scroll member having a wrap portion projecting axially from an end plate, said wrap portion being wound spirally from a radially inner side toward a radially outer side of said end plate; and a second scroll member provided facing said first scroll member, said second scroll member having a wrap portion projecting axially from an end plate, said wrap portion being wound spirally from a radially inner side toward a radially outer side of said end plate so as to overlap the wrap portion of said first scroll member to define a plurality of compression chambers;

wherein at least one of said scroll members has on a peripheral surface of the wrap portion thereof a plurality of axially extending projections at spacings in a spiral direction of said wrap portion, said projections each having a transverse sectional configuration defined by a top of the projection and slopes connecting the top to said peripheral surface, each of said slopes having a concave surface at a portion thereof that is contiguous to said peripheral surface, and wherein said projections are formed only on a limited axial part of the wrap portion away from said end plate, with the surfaces of the tops of the projections being flush with the remaining peripheral surface of the wrap portion having no projections.

* * * * *